US007108550B2

(12) United States Patent
Murakami et al.

(10) Patent No.: US 7,108,550 B2
(45) Date of Patent: Sep. 19, 2006

(54) CONNECTOR

(75) Inventors: Takao Murakami, Shizuoka-ken (JP); Chieko Torii, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/616,976

(22) Filed: Jul. 11, 2003

(65) Prior Publication Data

US 2005/0090161 A1 Apr. 28, 2005

(30) Foreign Application Priority Data

Jul. 23, 2002 (JP) ..... P2002-214354

(51) Int. Cl.
*H01R 13/40* (2006.01)

(52) U.S. Cl. ..... 439/595

(58) Field of Classification Search ..... 439/595, 439/587, 752

See application file for complete search history.

(56) References Cited

U.S. PATENT DOCUMENTS 5,575,684 A * 11/1996 Uchida et al. ..... 439/595
5,700,162 A 12/1997 Hatagishi et al.
5,733,144 A 3/1998 Tsuji et al.
5,839,921 A 11/1998 Yamanashi
6,390,849 B1 * 5/2002 Yamanashi et al. ..... 439/595

FOREIGN PATENT DOCUMENTS

EP 1 209 766 A2 5/2002
JP 61-218081 9/1986

* cited by examiner

*Primary Examiner*—Alexander Gilman
(74) *Attorney, Agent, or Firm*—Finnegan, Henderson, Farabow, Garrett & Dunner, L.L.P.

(57) ABSTRACT

A connector includes terminals having engagement parts. The connector includes a connector housing having chambers configured to insert and receive the terminals from the rears of the chambers. The connector includes projecting flexible locking arms including locking parts configured to lock with the engagement parts of the terminals. A single flexible arm is positioned to each of the chambers. The flexible locking arm has a front end supported on a front wall of the connector housing. The flexible locking arm has a rear end supported on a peripheral wall of the connector housing. The flexible locking arm includes a flexible part between the front and rear ends. The flexible part includes a locking part. The flexible part is flexibly deformable relative to an engagement part of a terminal. The locking part is lockable with the engagement part of the terminal received in a chamber.

10 Claims, 6 Drawing Sheets

CONNECTOR

BACKGROUND OF THE INVENTION

The present invention relates to a connector, and more particularly, to a connector used for a vehicle. This connector has a locking structure for a terminal, wherein a flexible locking arm (a so-called lance) locks a terminal received in a terminal receiving chamber of a connector housing.

A connector having this type of locking structure for a terminal is disclosed in Japanese Patent Laid-Open Publication S61-218081 (published in 1986).

This connector includes a terminal receiving chamber formed from the center of a connector housing toward the rear thereof. This receiving chamber includes a flexible locking arm protruding in a single-support beam shape therein. The locking arm extends obliquely forward from a top wall of the connector housing.

The receiving chamber has an opening at the rear end thereof. A terminal, which has an electric wire connected thereto, is inserted through the opening and received in the receiving chamber. The locking arm has a concave free end, which locks a step part of the terminal and can prevent the terminal from falling off in a rearward direction.

SUMMARY OF THE INVENTION

The connector, however, has a single-support structure, in which a fixed end of the locking arm is provided integrally on the top wall. With this structure, the flexible locking arm has been apt to yield, and a holding force for the terminal has been weak. Particularly, there has been a possibility that the strong pulling of the electric wire can cause the terminal to be disconnected from the locking arm, with the result that the terminal falls off.

The present invention is directed to a connector, which is capable of further enhancing the retaining force for the connector by the flexible locking arm.

A first aspect of the invention provides a connector. The connector includes a connector housing including a chamber defined by a wall and configured to receive a terminal. The connector includes a flexible locking arm having a first portion supported and a second portion supported by the wall and configured to lock with the terminal between the first and second portions.

Preferably, the wall includes opposed first and second sidewalls. The first portion is supported by a first sidewall.

Preferably, the locking arm includes a locking part extending toward a second sidewall and configured to lock with the terminal.

Preferably, the locking part is supported by the wall.

Preferably, the wall includes opposed sidewalls, and a first top wall extending between the sidewalls. The second portion is supported by the first top wall.

Preferably, the chamber has an opening configured to fit the terminal in the opening.

Preferably, the opening is shaped in a plane rectangle.

Preferably, the locking arm includes a second top wall configured to cover the opening.

Preferably, the terminal includes a projection covered with the second top wall.

Preferably, the locking part includes a disengagement part engagable with a disengagement fixture. The wall includes a guide passage for leading the disengagement fixture to the disengagement part. The disengagement fixture and the disengagement fixture engage with each other to disengage the terminal and the locking part from each other.

A second aspect of the invention provides a connector. The connector includes terminals having engagement parts. The connector includes a connector housing having chambers configured to insert and receive the terminals from the rears of the chambers. The connector includes projecting flexible locking arms including locking parts configured to lock with the engagement parts of the terminals. A single flexible arm is positioned to each of the chambers. The flexible locking arm has a front end supported on a front wall of the connector housing. The flexible locking arm has a rear end supported on a peripheral wall of the connector housing. The flexible locking arm includes a flexible part between the front and rear ends. The flexible part includes a locking part. The flexible part is flexibly deformable relative to an engagement part of a terminal. The locking part is lockable with the engagement part of the terminal received in a chamber.

DETAILED DESCRIPTION OF THE PREFERRED EMBODIMENT

Figure 1A:
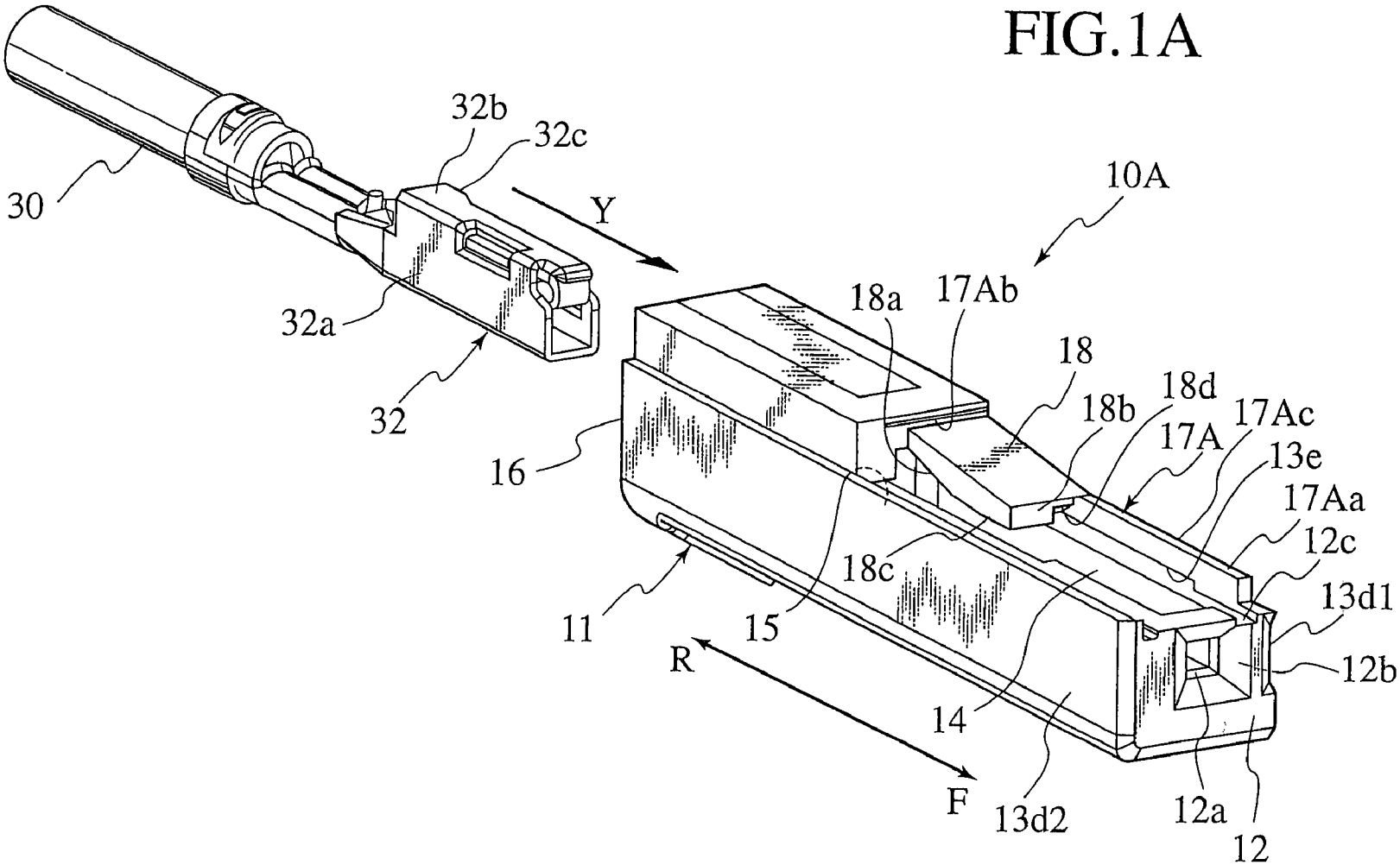
FIG. 1A is a partial perspective view illustrating a principal part of a connector and a terminal with an electric wire according to a first embodiment.
Figure 1B:
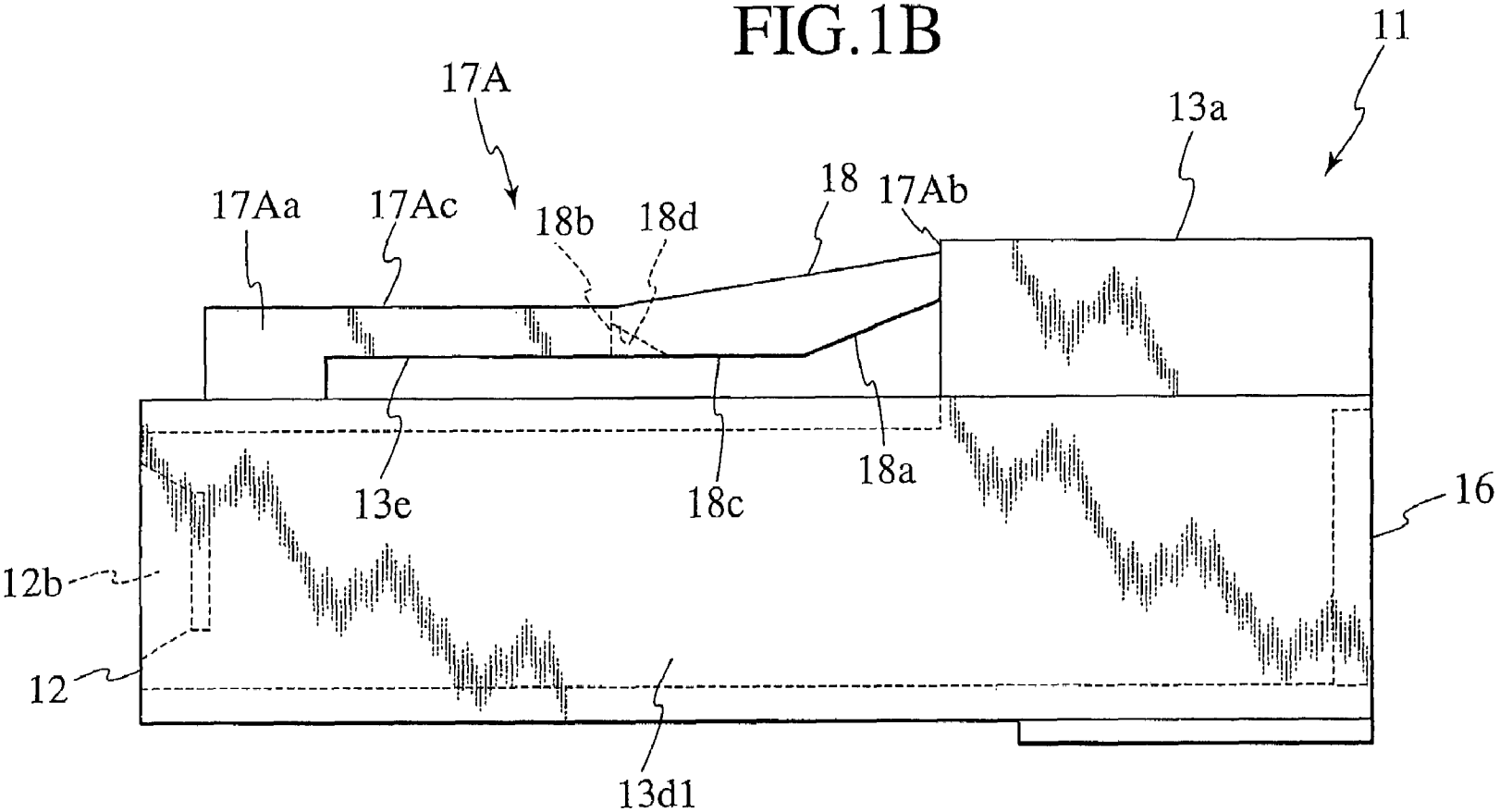
FIG. 1B is a side view of a connector housing of FIG. 1A.
Figure 2:
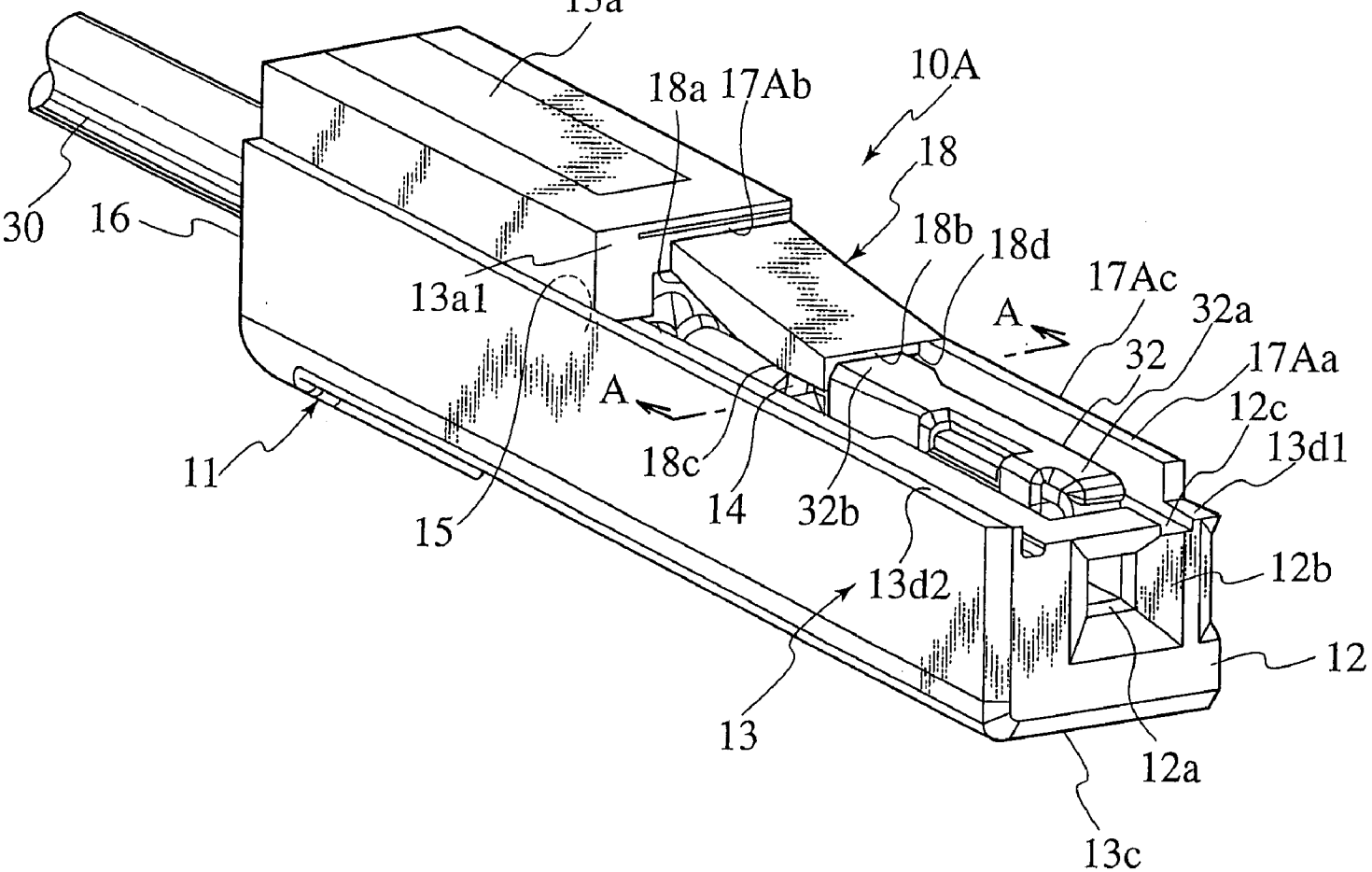
FIG. 2 is a partial perspective view illustrating the connector to which the terminal is assembled according to the first embodiment.
Figure 3:
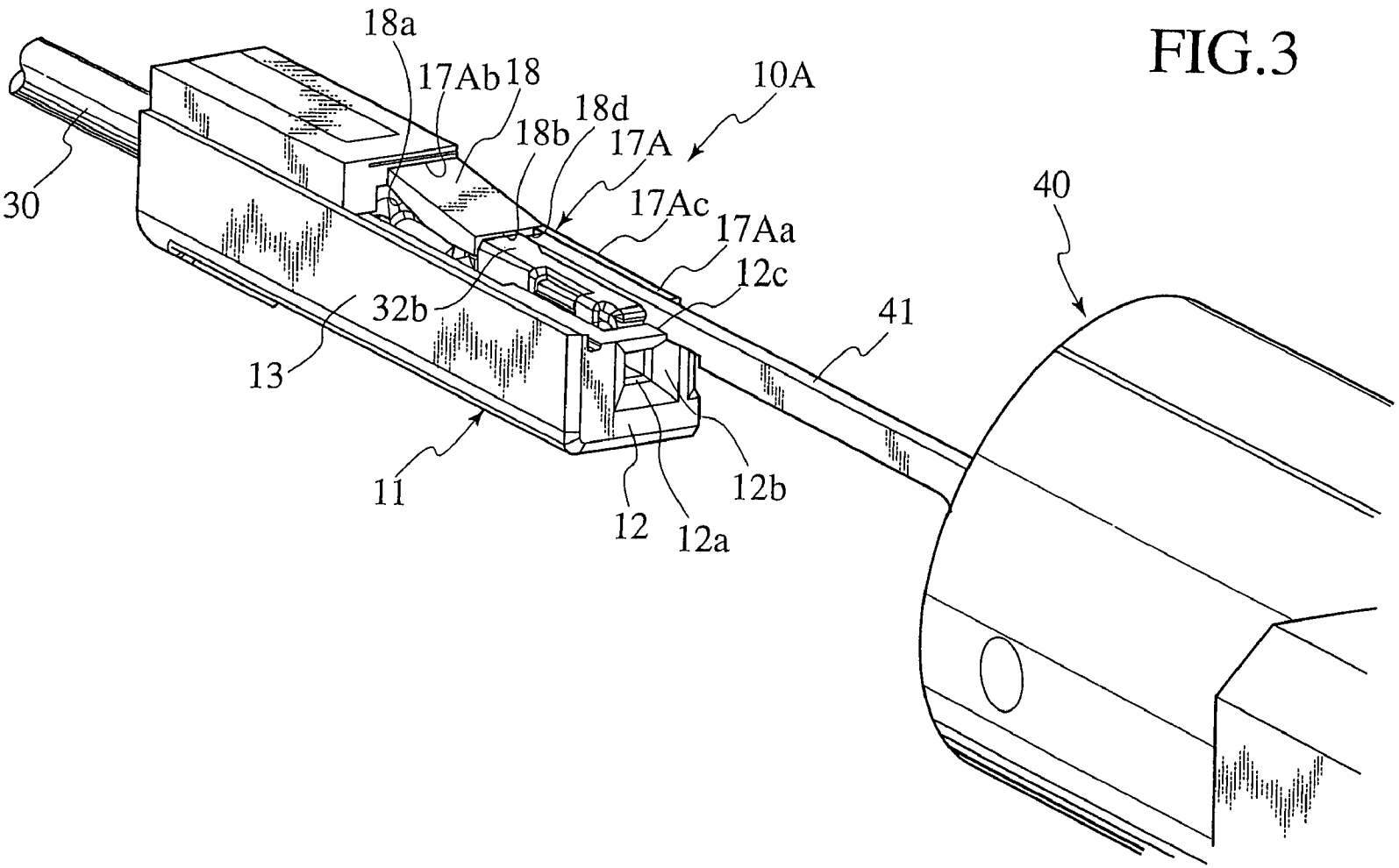
FIG. 3 is a partial perspective view illustrating a state of removing the terminal by use of a disengagement fixture in the first embodiment.
Figure 4:
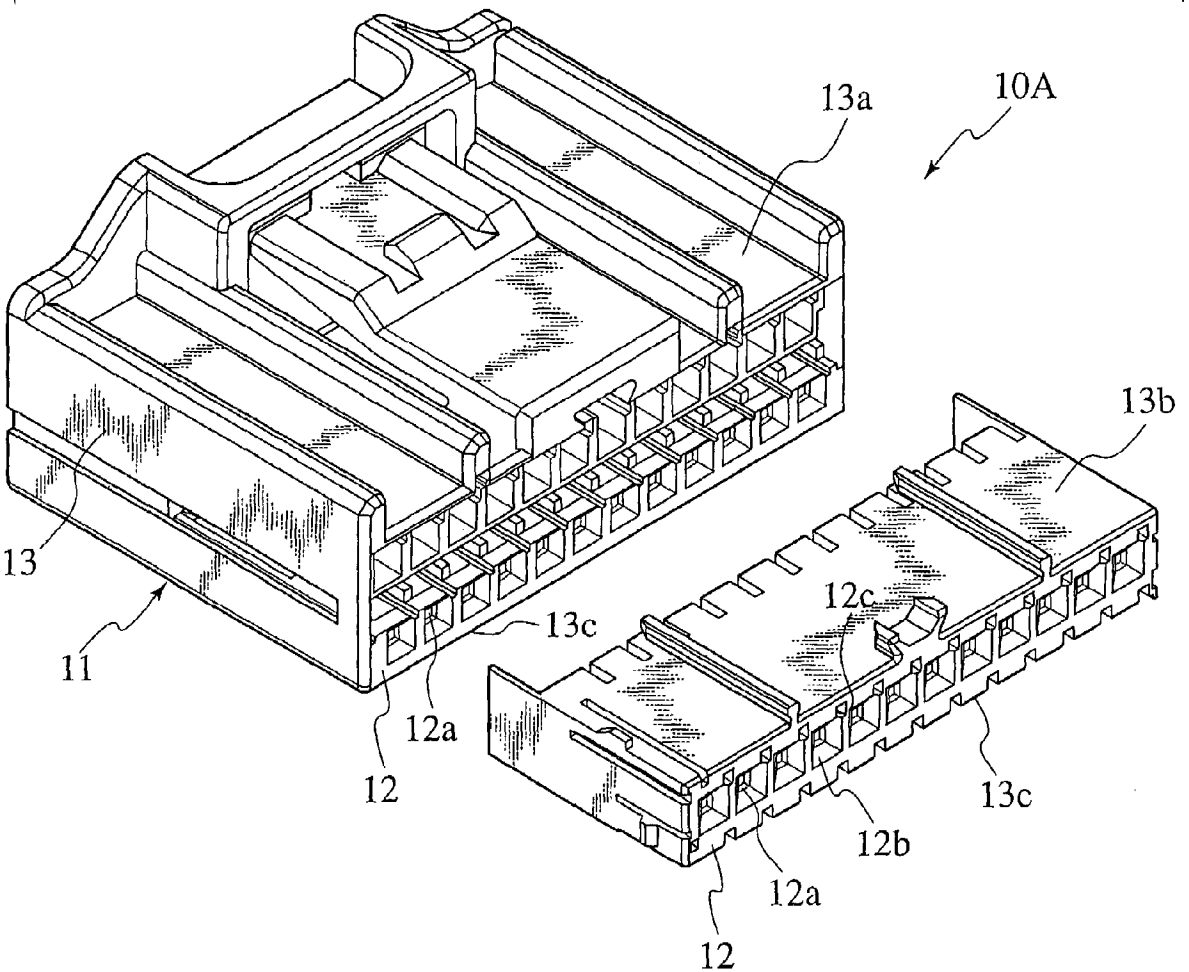
FIG. 4 is an overall perspective view illustrating the connector according to the first embodiment.
Figure 5:
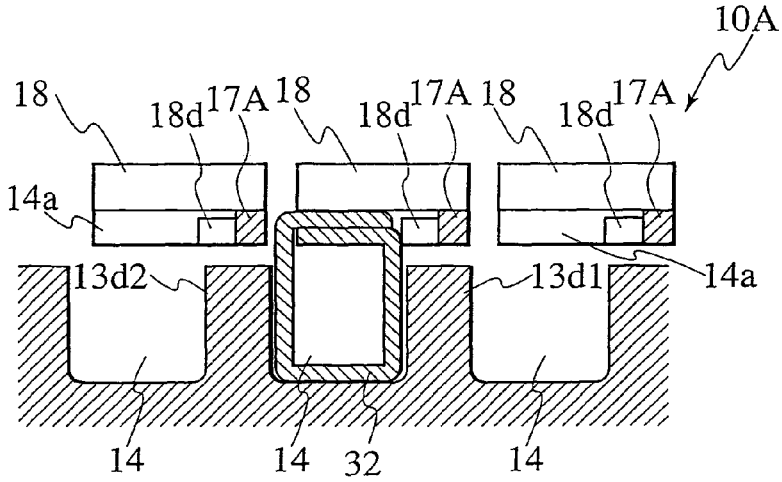
FIG. 5 is a cross-sectional view of a principal part, taken along a line A—A of FIG. 2.

Embodiments of the present invention will be described below based on the drawings.

As illustrated in FIGS. 1A to 4, connector 10A includes connector housing 11 made of synthetic resin. Connector 10A is surrounded by front end wall 12 and peripheral wall 13. Connector housing 11 includes therein terminal receiving chambers 14 and crimper receiving chambers 15, both of which are arranged in two stages in the longitudinal direction and in plurality in the transverse direction. Each chamber 14 is formed in a tube shape with a rectangular cross section. Each chamber 15 is formed in a tube shape with a circular cross section. Both chambers 14 and 15 communicate with each other. Female terminal 32 attached by pressure onto electric wire 30 is inserted into terminal inserting opening 16 located rearward and is received in both chambers 14 and 15.

Connector housing 11 has terminal inserting hole 12*a* formed in a position of front end wall 12, which is opposed to each chamber 14. A mating terminal of a mating connector (not shown) is inserted through hole 12*a*. Each hole 12*a* is formed into a tapered square hole which is open outward, thus facilitating the insertion therethrough of the mating terminal.

Connector housing 11 includes peripheral wall 13 with top wall 13*a*, partition 13*b*, bottom wall 13*c* and side walls 13*d*1 and 13*d*2. These walls 13*a* to 13*d*1 and 13*d*2 define each the chamber 14 and 15 individually.

Connector housing 11 includes front opening 12*b* of front end wall 12, which is opposed to chambers 14. Each chamber 14 extends from front opening 12*b* to the front end (13*a*1) of top wall 13*a* (partition 13*b* on a lower stage) of peripheral wall 13. Chambers 14 and 15 have boundary portion 13*a*1 therebetween. Boundary portion 13*a*1 includes flexible locking arm 17A protruding therefrom as a single piece. The locking arm 17A extends from front to rear in the Y direction. Locking arm 17A includes locking part 18, which locks engagement part 32*b* of terminal 32. Terminal 32 is received in opening 14*a*, which is rectangular in plane, on each chamber 14.

Locking arm 17A is provided for each chamber 14. Locking arm 17A has front end 17Aa, which is formed integrally on front opening 12*b* of front end wall 12. Front end wall 12 is located at the front end of side wall 13*d*1 as one of the side walls. Locking arm 17A has rear end 17Ab, which is formed integrally with boundary portion 13*a*1 between receiving chambers 14 and 15 located in the rear of side wall 13*d*1. Locking arm 17A includes locking part 18 which locks engagement part 32*b* of terminal 32 to be described later. Locking part 18 protrudes toward side wall 13*d*2 as the other side wall opposed to side wall 13*d*1. Locking part 18 has an upper rear end, and the upper rear end is formed integrally with boundary portion 13*a*1 between chambers 14 and 15, which is positioned in the rear of connector housing 11.

Locking part 18 formed integrally with locking arm 17A has a rear end. The lower part of the rear end inclines upward, and specifies lower incline 18*a*. Incline 18*a* inclines with respect to bottom 18*c* extending in the Y direction where the terminal is inserted. Incline 18*a* guides terminal 32 into chamber 14, thus facilitating the insertion thereto of terminal 32. Locking arm 18 has a front, which becomes locking surface 18*b* orthogonal to the Y direction.

Locking arm 17A includes flexible part 17Ac between front end 17Aa and locking part 18. Flexible part 17Ac has a lower part. This lower part defines cut-out 13*e* formed in a horizontal concave groove shape, which serves as a flex allowable space. Flexible part 17Ac freely flexes toward engagement part 32*b* of terminal 32 along the direction orthogonal to the Y direction. Locking surface 18*b* of locking part 18 locks engagement part 32*b* of terminal 32 received in chamber 14. Cut-out 13*e* of receiving chamber 14 guides convex portions 32*c* of terminal body 32*a*.

A boundary portion between locking arm 17A and locking part 18 includes disengagement part 18*d*. The front end of disengagement part 18*d* has a lower part, which inclines upward with respect to bottom 18*c*, and specifies a lower incline. This incline facilitates disengagement piece 41 of disengagement fixture 40 to be inserted into disengagement part 18*d*. The front wall of connector housing 11 has front opening 12*c* having access to disengagement part 18*d*. Insertion of disengagement piece 41 of fixture 40 from front opening 12*c* to disengagement part 18*d* allows the tip of disengagement piece 41 to thrust up the lower incline. This upthrust releases the engagement of locking part 18 and engagement part 32*b*.

In connector 10A described above, terminal 32 with electric wire 30 crimp contacted thereto is inserted to receiving chamber 14 from rear opening 16 of connector housing 11 through receiving chamber 15. This insertion allows the front edge of the upper piece of terminal body 32*a* to abut against incline 18*a* of locking part 18. This flexes flexible part 17Ac of flexible arm 17A upward, and places locking part 18 onto terminal body 32*a*.

When terminal 32 is further inserted, locking arm 17A returns to the original position thereof. Locking surface 18*b* of locking part 18 is locked with engagement part 32*b* of terminal body 32*a* in receiving chamber 14.

Locking arm 17A extends from front to rear in receiving chamber 14, and the rear thereof protrudes upward. Front and rear ends 17Aa and 17Ab of locking arm 17A are supported by connector housing 11, which specifies a double support. The double support allows locking arm 17A to be difficult to yield, and further enhances the retaining force for terminal 32 exerted by locking part 18 of locking arm 17A. Strong pulling of electric wire 30 rearward allows engagement part 32*b* of terminal 32 to abut against locking surface 18*b* of locking part 18 for locking together. This locking prevents terminal 32 from being disconnected and falling from locking part 18 of locking arm 17A.

When terminal 32 is removed from connector housing 11, one disengagement part 18*d* is operated by use of fixture 40. This operation can disengage the engagement of locking part 18 with engagement part 32*b* of terminal 32, which simplifies disengagement work. The operation requires single disengagement piece 41 provided to fixture 40 for each terminal receiving chamber. This simplifies the structure of disengagement fixture 40, and reduces manufacturing costs thereof.

Figure 6:
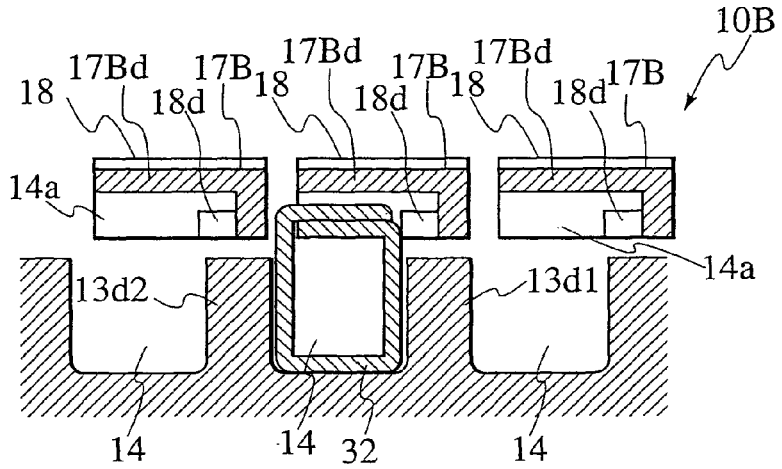
FIG. 6 is a cross-sectional view of a principal part according to a second embodiment, taken along a position corresponding to the line A—A of FIG. 2.

Referring to FIG. 6, this connector 10B of a second embodiment includes top board 17Bd formed integrally with flexible locking arm 17B. Top board 17Bd covers receiving chamber 14. Locking arm 17B and top board 17Bd define a terminal receiving space therebetween. It is possible to receive the upper part of terminal body 32*a* in the space. Other configurations are similar to those of connector 10 of the first embodiment, the same reference numerals are attached to the same constituent parts, and detailed description therefor will be omitted.

According to connector 10B described above, it is possible to receive the upper part of terminal body 32*a* in the terminal receiving space formed between locking arm 17B and top board 17Bd. When locking surface 18*b* of locking part 18 locks engagement part 32*b* of terminal 32, the upper part of terminal body 32*a* is completely received in the space and held securely.

Thus, any rattling of terminal 32 in receiving chamber 14 is easily and securely controlled. This further enhances the reliability of a connection between terminal 32 and the mating terminal (not shown).

Figure 7:
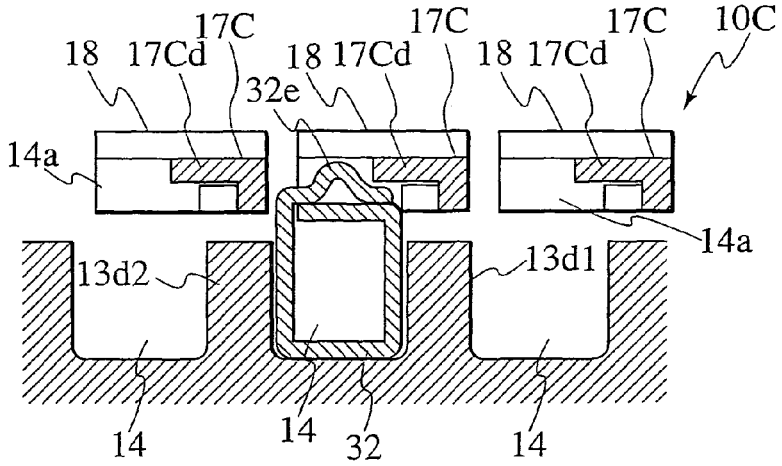
FIG. 7 is a cross-sectional view of a principal part according to a third embodiment, taken along a position corresponding to the line A—A of FIG. 2.

Referring to FIG. 7, this connector 10C of a third embodiment includes top board 17Cd formed integrally with the upper end of locking arm 17C. Top board 17Cd covers a part of receiving chamber 14. It is possible to receive the upper part of terminal body 32*a* in a terminal receiving space formed between locking arm 17C and top board 17Cd. The fact that terminal receiving chamber 14 is not entirely covered with top board 17Cd enables protrusion 32*e* protruded on the upper part of terminal body 32*a* by bending to be received in chamber 14. Other configurations are similar to those of connectors 10A and 10B of the first and second embodiments, the same reference numerals are attached to the same constituent parts, and detailed description therefor will be omitted.

According to connector 10C, top board 17Cd is formed on locking arm 17C, and protrusion 32*e* protruded on the upper part of terminal body 32*a* is receivable in chamber 14. Locking surface 18*b* locks engagement part 32*b* of terminal 32, and thus the upper part of terminal body 32*a* can be received completely in the terminal receiving space between locking arm 17C and top board 17Cd and held securely.

This can control the rattle of terminal 32 in terminal receiving chamber 14 more easily and securely, and can further enhance the reliability of the connection between terminal 32 and the mating terminal.

Although the respective embodiments have described the connectors, each receiving female terminals, the respective embodiments can be applied to connectors, each receiving male terminals.

The entire contents of Japanese Patent Application P 2002-214354 (filed on Jul. 23, 2002) are incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

According the invention, supporting of the first and second portions of the flexible locking arm on the wall allows the locking arm to be difficult to yield, when the locking arm locks with the terminal. This enhances the retaining force for the terminal.

The locking arm with sufficient retaining force for the terminal allows pitch between terminals to be reduced. This achieves a smaller connector in size.

The locking part with a relatively simple structure further prevents the locking arm from yielding during locking of the terminal with the locking part. This enhances the retaining force of the locking part against the terminal.

The supporting of the locking part on the wall further prevents the locking arm from yielding during locking of the terminal with the locking part, which enhances the retaining force of the locking part against the terminal.

The opening securely prevents the terminal from rattling, which enhances the contact reliability of the terminal with a mating terminal.

The second top wall retains against the terminal to securely prevent rattling of the terminal, thus enhancing the contact reliability of the terminal with a mating terminal.

The second top wall retains against the projection of the terminal to securely prevent rattling of the terminal, thus enhancing the contact reliability of the terminal with a mating terminal.

The operation of the disengagement part allows the locking part and terminal to be disengaged from each other. This simplifies the disengagement operation, and achieves the disengagement operation with a single disengagement fixture, which simplifies the disengagement fixture in structure and reduces production cost.

What is claimed is:

1. A connector comprising:

a connector housing including a chamber defined by a wall and configured to receive a terminal; and a flexible locking arm having a first portion and a second portion supported by the wall and configured to lock with the terminal between the first and second portions, wherein the flexible locking arm extends obliquely from a top of the connector housing, wherein the wall of the chamber includes opposed first and second sidewalls, and wherein the first portion of the flexible locking arm is supported by the first sidewall.

2. The connector according to claim 1, wherein the wall of the chamber includes opposed first and second sidewalls, and a top wall extending between the first and second sidewalls, wherein the second portion of the flexible locking arm is supported by the top wall of the chamber.

3. The connector according to claim 1, wherein the flexible locking arm includes a locking part extending toward the second sidewall and configured to lock with the terminal.

4. The connector according to claim 3, wherein the locking part includes a disengagement part engagable with a disengagement fixture, wherein the wall of the chamber includes a guide passage for leading the disengagement fixture to the disengagement part, and wherein the disengagement fixture and the disengagement part engage with each other to disengage the terminal and the locking part from each other.

5. The connector according to claim 1, wherein the chamber has an opening configured to fit the terminal in the opening.

6. The connector according to claim 5, wherein the opening is shaped in a plane rectangle.

7. The connector according to claim 5, wherein the flexible locking arm includes a top wall configured to cover the opening.

8. The connector according to claim 7, wherein the terminal includes a projection covered with the top wall of the flexible locking arm.

9. A connector comprising:

terminals having engagement parts;

a connector housing having chambers configured to insert and receive the terminals from the rears of the chambers; and a plurality of projecting flexible locking arms including locking parts configured to lock with the engagement parts of the terminals, wherein each flexible locking arm is positioned to correspond with one of the chambers, wherein each chamber includes opposed first and second sidewalls, wherein the locking part of the flexible locking arm extends toward the second sidewall, wherein the flexible locking arm has a front end supported on a front wall of the connector housing, wherein the flexible locking arm has a rear end supported on a peripheral wall of the connector housing, wherein the flexible locking arm includes a flexible part between the front and rear ends, and the flexible part includes a locking part, and wherein the flexible part is flexibly deformable relative to an engagement part of a terminal, and the locking part is lockable with the engagement part of the terminal received in a chamber.

10. A connector comprising:

a connector housing including a chamber defined by a wall and configured to receive a terminal, a flexible locking arm having a first portion and a second portion supported by the wall and configured to lock with the terminal between the first and second portions, wherein the wall includes opposed first and second sidewalls, wherein the first portion of the flexible locking arm is supported by the first sidewall, wherein the flexible locking arm includes a locking part extending toward the second sidewall and is configured to lock with the terminal, and wherein the locking part is supported by the wall of the chamber.

* * * * *